US006833399B2

(12) United States Patent
Khavkine et al.

(10) Patent No.: US 6,833,399 B2
(45) Date of Patent: Dec. 21, 2004

(54) FLOWABLE FLAX BAST FIBER AND FLAX SHIVE BLEND USEFUL AS REINFORCING AGENT

(75) Inventors: Mikhail Khavkine, Newmarket (CA); Barbara Isman, Winnipeg (CA)

(73) Assignee: Cargill, Limited, Winnipeg (CA)

( * ) Notice: Subject to any disclaimer, the term of this patent is extended or adjusted under 35 U.S.C. 154(b) by 0 days.

(21) Appl. No.: 10/230,364

(22) Filed: Aug. 28, 2002

(65) Prior Publication Data

US 2003/0129394 A1 Jul. 10, 2003

(Under 37 CFR 1.47)

Related U.S. Application Data

(60) Provisional application No. 60/323,970, filed on Sep. 21, 2001.

(51) Int. Cl.[7] ..... C08L 97/02

(52) U.S. Cl. ..... 524/9; 524/35; 536/35; 536/56; 19/145.5

(58) Field of Search ..... 524/9, 35; 536/56, 536/124; 19/145.5

(56) References Cited

U.S. PATENT DOCUMENTS

| | | | | |
|---|---|---|---|---|
| 4,800,113 | A | 1/1989 | O'Connor | |
| 4,913,937 | A | 4/1990 | Engdahl et al. | |
| 5,116,668 | A | 5/1992 | Yamamoto et al. | |
| 5,122,417 | A | 6/1992 | Murakami et al. | |
| 5,228,175 | A | 7/1993 | Olry et al. | |
| 5,358,767 | A | 10/1994 | Bompard et al. | |
| 5,554,330 | A | 9/1996 | Flannery et al. | |
| 5,618,624 | A | 4/1997 | Dinger et al. | |
| 5,654,067 | A | 8/1997 | Dinger et al. | |
| 5,714,226 | A | 2/1998 | Disselbeck | |
| 5,720,083 | A | 2/1998 | Leduc et al. | |
| 5,741,382 | A | 4/1998 | Ma et al. | |
| 5,792,555 | A | 8/1998 | Bak et al. | |
| 5,856,243 | A | 1/1999 | Geirhos et al. | |
| 5,885,394 | A | 3/1999 | Scherzer et al. | |
| 5,888,609 | A | 3/1999 | Karttunen et al. | |
| 5,906,030 | A | 5/1999 | Leduc et al. | |
| 5,910,361 | A | 6/1999 | Guevel et al. | |
| 6,025,285 | A | 2/2000 | Vyakarnam et al. | |
| 6,051,313 | A | 4/2000 | Olry et al. | |
| 6,051,316 | A | 4/2000 | Boissannat et al. | |
| 6,054,177 | A | 4/2000 | Endoh et al. | |
| 6,079,647 | A | 6/2000 | Leduc et al. | |
| 6,114,416 | A | 9/2000 | Kolla et al. | |
| 6,133,348 | A | 10/2000 | Kolla et al. | |
| 6,139,956 | A | 10/2000 | Endoh et al. | |
| 6,159,879 | A * | 12/2000 | Hesch | 442/152 |

FOREIGN PATENT DOCUMENTS

| | | |
|---|---|---|
| EP | 156599 | 10/1985 |
| EP | 156600 | 10/1985 |
| EP | 351201 | 1/1990 |
| EP | 378381 | 7/1990 |
| GB | 2090849 A | 7/1982 |
| JP | 4353525 | 12/1992 |
| JP | 8280418 | 10/1996 |
| WO | WO 9933639 | 7/1999 |

OTHER PUBLICATIONS

AgFiber Technology News, Oct. 31, 2000, vol. 2, No. 13, Issue 37.

Byung–Dae Park and John J. Balatinecz, A Comparison of Compounding Processes for Wood–Fiber/Thermoplastic Composites, Polymer Composites, Jun. 1997, p. 425, vol. 18, No. 3.

P.R. Hornsby, E. Hinrichsen and K. Tarverdi, Preparation and properties of polypropylene composites reinforced with wheat and flax straw fibres, Journal of Materials Science, Jan. 15, 1997, vol. 32, No. 2.

Billie J. Collier and Phyllis G. Tortora, "Understanding Textiles," Sixth Edition, pp. 250–262.

H. Gilbertson, "British Flax Fibre–New Markets," 4$^{th}$ Workshop of the FAO Network on Flax, Rouen, France, Sep. 25/28, 1996.

A.J. Michell and D. Wilis, "Cellullosic Fibres for Reinforcement," Mar. 1978, presented at 31$^{st}$ Annual Conference, Surfers Paradise, 1977.

K.P. Mieck, R. Lutzkendorf and T. Reussman, "Needle–Punched Hybrid Nonwovens of Flax and PPFibers–Textile Semiproducts for Manufacturing of Fiber Composites," Polymer Composites, Dec. 1996, vol. 17, No. 6.

* cited by examiner

*Primary Examiner*—Peter Szekely
(74) *Attorney, Agent, or Firm*—Fitch, Even, Tabin & Flannery

(57) ABSTRACT

This invention relates to free flowing fiber reinforcing material which includes a blend of flax bast fibers and flax shives with a specific distribution of particle sizes and aspect ratios, thermoplastic pellets which include such reinforcing fiber blend, thermoplastic composites which include such reinforcing fiber blend and method for making such pellets and composites.

46 Claims, No Drawings

FLOWABLE FLAX BAST FIBER AND FLAX SHIVE BLEND USEFUL AS REINFORCING AGENT

This application is a non-provisional application of and claims priority under 35 USC 119(e) to U.S. Provisional Application No. 60/323,970, of Khavkine et al., entitled, "Flowable Flax Bast Fiber and Flax Shive Blend Useful as Reinforcing Agent," filed Sep. 21, 2001, which is incorporated herein in its entirety by reference.

FIELD OF THE INVENTION

This invention is directed to a flowable flax bast fiber and flax shive blend which may be used as a reinforcing agent for thermoplastic resins.

BACKGROUND OF THE INVENTION

A number of different materials, such as organic and inorganic fibers, have been used to make thermoplastic composite reinforcements. Inorganic fibers include glass, carbon, metals or metal alloys, such as steel or aluminum, and stone. Organic fibers include aramid, nylon, polyester, polypropylene, polyethylene and natural fibers, such as cotton and wood.

Traditionally, milled fiberglass has been the most popular material for reinforcement of thermoplastic compounds. Fiberglass has a unique combination of versatility and strength that makes this reinforcement a material of choice for more than 50% of all composite articles manufactured in the year 2000, and the most popular choice for thermoplastic reinforcement as well. Synthetic organic fibers (nylon, polypropylene, aramid, etc.) are used occasionally and for specialty applications only. Despite their good availability, man-made fibers have significant disadvantages, including high prices tied to crude oil prices. All of these materials pressure the environment because they are not necessarily renewable, are not biodegradeable and generate significant Green House Gas emissions upon manufacture and/or destruction. Key disadvantages of fiberglass also include the worker-unfriendly nature of the material (fiberglass is an irritant), its fragility which makes it difficult to process; and finally, its density (natural fibers have specific density that is 40% less than density of fiberglass).

Because flax bast fibers are difficult to feed into resin molding equipment, they have not been used for thermoplastic reinforcing agents. Although the potential of using flax fibers in plastic applications as a substitute for synthetic fibers such as glass, carbon, nylon, polyester, etc. has been recognized, for example, GB 2090849 describes the incorporation of flax bast fibers into a thermoplastic resin blend. The use of flax bast fibers for reinforcing resins results in processing problems, as the flax bast fibers tend to "ball up" during processing. Thermoplastic resins blended with specific amounts of flax shives and bast fibers are not described. Further, purposeful attempts have been made to exclude flax shive from flax fiber preparations used for reinforcing composites. For example, Mieck et al. (*Polymer Composites*, December 1996, Vol. 17, No. 6), suggest that for better composite characteristics, the fibers should be free from shives. Flax bast fibers have very low-bulk density which tends to cause the aforedescribed clumping or balling. At the same time, almost all inorganic fibers have a very good feeding properties due to high-bulk density. However, this feeding advantage of inorganic fibers creates a problem for the composite. It makes composites heavy.

U.S. Pat. Nos. 6,133,348 and 6,114,416 to Kolla et al. describe a shive/bast fiber blend used as a resin reinforcing agent where the blend has 30 weight percent bast fibers as a maximum. If the blend described in these patents has more than 10 weight percent bast fibers, without using shives and bast fibers as described herein, feeding problems will be incurred because the bast fibers will ball and clump. Neither the '348 patent or the '416 patent suggest a flax bast fiber/shive blend with the aspect distribution and/or particle size distribution described herein.

It also has been known that fibers could be chopped or reduced in their length to improve the reinforcement feeding properties. This approach is widely used with inorganic fibers. Milled glass fibers are glass fibers processed by a hammer mill into lengths of 1/32" to 1/81". There are many brands of milled inorganic fibers (e.g., West System 1/32" Milled Glass Fiber), which found broad application as reinforcement for thermoplastic compounds.

OBJECTS OF THE INVENTION

It is an object of the invention to provide a blend of flax bast fibers and flax shives which are flowable and which will not clog or clump in thermoplastic resin forming equipment.

This and other objects of the invention will become apparent with reference to the specification.

SUMMARY OF THE INVENTION

This invention relates to free flowing fiber reinforcing material which includes a blend of flax bast fibers and flax shives with a specific distribution of particle sizes and aspect ratios, thermoplastic pellets which include such reinforcing fiber blend, thermoplastic composites which include such reinforcing fiber blend and method for making such pellets and composites. The flax bast fibers and flax shives each have particle size ranges in amounts which are sufficiently similar and short which makes the blend free flowing and feedable into equipment which receives and shapes thermoplastic resins without the addition of other surface treating agents for the flax bast fibers. The particle sizes of the bast fiber are sufficiently long to make the bast fiber/shive blend an effective reinforcing agent for thermoplastic resins. Moreover, for a given particle size, the shives have a smaller average aspect ratio value than the plant bast fibers. The similarity of the amounts of flax shives and bast fibers in a given particle size range, and the smaller aspect ratio of the shives compared to the aspect ratio of the bast fiber all are effective for making the reinforcing blend freely flowable and feedable into resin processing equipment. Once introduced into such resin processing equipment, the blend can be easily compounded with a thermoplastic resin, which is softened by heating, and the resulting flowable mixture can be thermoformed into desired bast fiber/shive reinforced composite shape.

The resulting fiber reinforced composites are relatively light-weight yet strong and flexible structures well-suited for diverse applications. In one aspect, solid flowable pellets are made as an intermediate product which is a mixture of the flax bast fiber/flax shive blend and thermoplastic resin to provide an intermediate composite product. The fiber reinforced resin pellets can be used subsequently as a convenient ready-to-use feed for an injection mold or extruder.

As noted above, heretofore flax bast fibers have been known to clump or "ball up" and obstruct their feeding into and or within passageways in resin processing equipment. Surprisingly, the blend of the invention which has at least about 15 weight percent flax bast fibers can significantly minimize or eliminate such clumping, and, in general, the blend should have at least about 30 weight percent bast fiber to further enhance the reinforcing properties of the blend. The blending of the flax bast fibers and flax shives can be accomplished before or during compounding with the thermoplastic matrix resin in resin processing equipment. When preblended, a free flowing form of flax fibers and shives is provided suitable for clog-free feeding into resin processing equipment. Once introduced into the resin processing equipment, the flax bast fibers and shives in the blend continue to interact in a manner that effectively inhibits and curbs clumping problems arising from the bast fibers. These problems would occur if a natural ratio of flax bast fiber and flax shive were used during compounding and movement of the fiber/flax shive/resin blend within the equipment.

While not desiring to be bound to any theory, it is believed that the flax shives surround exterior portions of the low bulk density flax bast fibers when blended according to the particle size and aspect ratio distribution criteria of this invention. This sufficiently inhibits the bast fibers from physically bridging or hooking together to otherwise form undesired clumps or agglomerates of bast fibers. It is believed that the flax shives serve to "lubricate" the flax bast fibers to effectively suspend them as a shive/bast fiber dispersion and keep the bast fibers from mechanically entangling with one another. As a consequence, a relatively freely-flowable blend of flax shives and bast fibers is achieved that permits substantially uniform feeding into and through constrictions and feeding inlets of resin processing equipment.

In one aspect, the flax bast fiber portion comprises from about 15 to about 70 weight percent of the blend and the flax shive portion comprises from about 85 to about 30 weight percent of the blend. The flax bast fibers of the bast portion and the shives of the shive portion have a plurality of particle size ranges and aspect ratio ranges which effect the flowability of the blend and make it more flowable than a comparative blend that comprises about 70 weight percent shives and about 30 weight percent bast fiber without any adjustment of the distribution of particle sizes or aspect ratios from that which is naturally supplied by the flax plant when it is decorticated. A blend of about 70 weight percent shives and 30 weight percent bast fibers is that ratio of shives to fiber in a flax plant and which would be obtained from flax upon decorticating (i.e., stripping and cleaning) a flax plant as would be described in U.S. Pat. Nos. 6,079,647; 5,906,030 and 5,720,083 which are incorporated herein and without milling and/or particle separation of the shive and bast particles subsequent to decortication. The particle size distribution and aspect ratios as described herein are obtained by screening and aspiration equipment as is known in the art down stream of the methods and equipment described in the aforedescribed patents. The distribution of respective particle sizes of bast fibers and shives and aspect ratios of the flax bast fiber portion and the flax shive portion are selected and blended to effect the above-discussed unique lubricating effect on the flax bast fibers and prevent them from clumping or at least reduce the clumping as compared to a blend having a ratio of shives to bast fibers of about 7 to about 3, where the blend has particle sizes and aspect ratios which have not been preselected to provide flowability in a thermoplastic resin. It has been discovered that a flax bast fiber portion can be provided that not only is conducive for making such a flowable fiber blend, but which also still possesses a particle size effective for increasing at least one of the tensile and flexural strength of the resin in which it is embedded, such as an increase of at least about 10%, when the flax bast fiber portion is loaded in the resin in an amount of 30 percent by weight. Thus, the flowability of the flax bast fibers is achieved without sacrificing or unduly diminishing the ultimate reinforcing properties or other positive attributes contributed by the flax bast fibers to thermoplastic composites in which they are embedded.

The natural flax fiber content in the fiber reinforced composites of this aspect of the invention effectively displaces more costly thermoplastic matrix resin content or thermoplastic fiber reinforcements in the composite. The natural plant fiber materials such as flax used in the invention are low cost, light-weight, available in many regions of the world and environmentally friendly materials. Moreover, a freely-flowable plastic matrix composition suited for handling in plastic processing equipment is provided without the need to resort to inorganic fibrous reinforcing materials, such as fiberglass, having disadvantages including increased weight and their irritant nature.

DETAILED DESCRIPTION OF THE INVENTION EMBODIMENT

Definitions

"Particle size" as referred to in the present application refers to the fiber length or major dimension of the plant bast fiber or shive, as applicable.

"Aspect ratio" refers to the fiber length/diameter (L/D) ratio value of either the plant bast fiber or shive, as applicable.

"Flax" refers to plant fiber crops being grown either for seed (i.e., linseed oil) or for its fiber or both. Examples of such crops include *Lignum usitatissimum* (common flax), *L. usitatissimum* album (white-flowered flax), and *L. usitatissimum* vulare (blue-flowered flax).

The high quality fibers of flax are from the stem of the plant and are in the phloem or bast, hence the reference to flax as a "bast fiber" crop. As used herein, "bast" refers to those fibers from the phloem region. Further, as used herein, flax "shives" refers to the core tissue particles that remain after bast fibers are separated (decorticated) from the flax stem. Flax shives includes blends and mixtures of all cell types including vascular bundles and parenchyma cells. The shives often can have a general "brick" shape, although this is not necessarily required.

Generally, the flowable flax bast fiber flax shive blend has from about 30% to about 55% by weight flax bast fibers which have an average aspect ratio ranging between about 6.0 and about 265.0, in another aspect between about 5.5 and about 300 for all bast particle sizes thereof, and from about 70% to about 45% by weight shives which have an average aspect ratio ranging between about 2.0 and about 4.5, in another aspect between about 1.5 and about 4.5 for all shive particle sizes thereof. The proportion of bast fibers in this flowable fiber blend of this invention is relatively high to that obtained naturally from flax, and the bast fiber content is more than adequate to provide the reinforcing effect desired in thermoplastic composites incorporating the fiber blend.

In another aspect, the blend of flax bast fibers and flax shives contains not more than about 5 weight percent of the shive portion that have a particle size more than about 500 microns and not more than about 35 weight percent of the flax bast portion that have a particle size greater than 355 microns. In this aspect, bast fibers of dimensions suitable for thermoplastic resin reinforcement are provided without the need to include a significant proportion of relatively long bast fibers, and thereby avoiding the presence of high levels of relatively longer bast fibers which, in general, may be more predisposed to the clumping problem.

The fiber reinforced resin composites made with the flowable fiber blend of the invention contain the thermoplastic matrix resin in an amount of at least about 10%, generally about 10% to about 90%, and more particularly about 30% to about 65% by weight of the reinforced composite. In one aspect, the fiber blend of the fiber reinforced resin composite generally comprises about 40 to about 60 weight percent of the reinforced composite. In addition, the fiber reinforced resin composite made with the flowable fiber blend disclosed herein can have a tensile strength of at least about 10 MPa, a tensile modulus of at least about 0.5 GPa, a flexural strength of at least about 15 MPa, and a flexural modulus of at least about 0.4 Gpa.

The thermoplastic resin should have a melting point below the thermal decomposition point of the flax bast fibers and the shives. Thermoplastic resin/resins which may be used in the invention include polypropylene, polyethylene, polyvinyl chloride, styrene, acrylonitrile, acrylonitrile-styrene, polyurethane, polyamide, acrylonitrile-butadiene-styrene, polyester and mixtures thereof. In one aspect the thermoplastic resin has a melting point of at least about 140° C., a density of less than about 1.5 g/cm$^3$, and a weight average molecular weight in the range of from about 50,000 to about 900,000.

As would be understood by those familiar with resin processing to make composites, the composite is made by forming it into a predetermined shape and hardening or permitting hardening of the shaped composite composition. Forming the resin may be injection molding, compression molding, blow molding, extruding, rotational molding , pelletizing, or casting. The blend of the flax shive portion and flax bast fiber portion should be substantially uniformly distributed throughout the thermoplastic resin. Processing aids such as a maleated polypropylene, a maleated polyethylene, a functionalized polyolefin and mixtures thereof may be added when making the composite.

In one particular aspect of the invention, the distribution of respective particle sizes and aspect ratios of the flax shive portion and the flax bast fiber portion is as follows:

Shive Portion

| Fraction | Particle of the Mesh # | Particle size (μm) | Avg. aspect ratio | Max. aspect ratio | Min. aspect ratio | Preferred aspect % total | Min. % embodiment of the fraction | Max % of the fraction |
|---|---|---|---|---|---|---|---|---|
| 1 | 35 | about >500 | about 2.1 | about 5.5 | about 1.1 | about 1 | about 0 | about 5 |
| 2 | 45 | about 355-about 500 | about 2.6 | about 5.3 | about 1 | about 4 | about 2 | about 12 |
| 3 | 60 | about 250-about 355 | about 3.6 | about 14.6 | about 1.60 | about 15 | about 2 | about 25 |
| 4 | 100 | about 150-about 250 | about 2.9 | about 9.9 | about 1 | about 20 | about 2 | about 30 |
| 5 | 200 | about 75-about 150 | about 4.4 | about 14.6 | about 0.8 | about 10 | about 0 | about 25 |
| TOTAL | | | | about 45-about weight 70 | | | | |

Bast Fiber Portion

| Fraction | Particle of the Mesh # | Particle size (μm) | Avg. aspect ratio | Max. aspect ratio | Min. aspect ratio | Preferred aspect % total | Min. % embodiment of the fraction | Max % of the fraction |
|---|---|---|---|---|---|---|---|---|
| 1A | 35 | about >500 | about 261 | about 920 | about 39 | about 2 | about 0 | about 35 |
| 2A | 45 | about 355-about 500 | about 126 | about 283 | about 63 | about 5 | about 0 | about 35 |
| 3A | 60 | about 250-about 355 | about 134 | about 308 | about 20 | about 15 | about 0 | about 40 |
| 4A | 100 | about 150-about 250 | about 81 | about 162 | about 35 | about 8 | about 1 | about 25 |
| 5A | 200 | about 75-about 150 | about 47 | about 81 | about 20 | about 10 | about 0 | about 20 |
| 6 | <200 | about <75 | about 6.1 | about 18.1 | about 2 | about 10 | about 2 | about 35 |
| TOTAL | | | | about 30-about weight 55 | | | | |

The bast fiber/flax shive blend of the invention may be combined with synthetic fibers which are organic or inorganic fibers. Such additional organic and inorganic fibers include glass, wollastonite, quartz, basalt, carbon, polyamide, polyester, or polyolefin fibers. Such additional fibers can be from about 2 to about 90 weight percent, preferably 15 to 60 weight percent, of the fiber fraction.

These fibers may stabilize the natural flax bast/shive blend, such that the distribution of aspect ratios in the bast fiber/shive blend will be advantageously maintained.

What is claimed is:

1. A blend of flax bast fibers and flax shives adapted for use as a reinforcing agent for a thermoplastic resin, the blend comprising:

a flax bast fiber portion, the flax bast portion comprising about 15 to about 70 weight percent of the blend, the flax bast having an average aspect ratio of about 6.0 to about 265; and a flax shive portion, the flax shive portion comprising about 30 to about 85 weight percent of the blend, the flax shives having an average aspect ratio of about 2.0 to about 4.5, the flax bast fiber portion having flax bast fibers and the flax shive portion having flax shives, the bast fibers and flax shives having selected particle size ranges and aspect ratio ranges which are effective for making the blend more flowable than a comparative blend comprising about 70 weight percent shives and about 30 weight percent bast fibers with particle sizes and aspect ratios in the comparative blend which have not been preselected to provide flowability in a thermoplastic resin, the flax bast fibers having particle sizes effective for increasing at least one of tensile strength and flexural strength of the resin which includes the flax bast fiber portion and flax shive portion by at least about 10% when the flax bast fiber portion is present in the resin in an amount of 30% by weight.

2. The blend of flax bast fibers and flax shives as recited in claim 1 wherein about 5 weight percent or less of the shives in the shive portion have a particle size of about 500 microns or more and about 35 weight percent or less of the flax bast fibers in the flax bast fiber portion have a particle size greater than 355 microns.

3. The blend of flax bast fibers and flax shives as recited in claim 1 wherein the shive portion comprises 0–5 weight percent shives having a particle size greater than 500 $\mu$m with an average aspect ratio of 2.1, 2 to 12 weight percent shives having a particle size of from 355 to 500 $\mu$m with an average aspect ratio of 2.6, 2 to 25 weight percent shives having a particle size of from 250 to 355 $\mu$m with an average aspect ratio of 3.6, 2 to 30 weight percent shives having a particle size of from 150 to 250 $\mu$m with an average aspect ratio of 2.9, 0 to 25 weight percent shives having a particle size of from 75 to 150 $\mu$m with an average aspect ratio of 4.4; and the flax bast fiber comprises 0 to 35 weight percent bast fibers having a particle size greater than 500 $\mu$m with an average aspect ratio of 261, 0 to 35 weight percent bast fibers having a particle size of 355 to 500 $\mu$m with an average aspect ratio of 126, 0 to 40 weight percent bast fibers having a particle size of 250 to 355 $\mu$m with an average aspect ratio of 134, 1 to 25 weight percent bast fibers having a particle size of 150 to 250 $\mu$m with an average aspect ratio of 81, 0 to 20 weight percent bast fibers having a particle size of 75 to 150 $\mu$m with an average aspect ratio of 47, and 2 to 35 weight percent bast fibers having a particle size about 75 $\mu$m or less with an average aspect ratio of 6.1.

4. The blend of flax bast fibers and flax shives as recited in claim 1, wherein the flax bast fibers have an average aspect ratio of about 5.5 to about 300.0, and the shives have an average aspect ratio of about 1.5 to about 4.5.

5. A fiber reinforced resin composite, comprising:

a thermoplastic resin; and a fiber blend, the fiber blend included in the thermoplastic resin, wherein the fiber blend comprises a flax bast fiber portion, comprising about 15 to 70 weight percent of the blend and having an average aspect ratio of about 6.0 to about 265.0, and a flax shive portion, comprising 30 to 85 weight percent of the blend and having an average aspect ratio of about 2.0 to about 4.5, the flax bast portion having flax bast fibers and the flax shive portion having flax shives, the bast fibers and the flax shives having selected particle size ranges and aspect ratio ranges which are effective for making the blend more flowable than a comparative blend comprising about 70 weight percent shives and about 30 weight percent bast fibers with particle sizes and aspect ratios in the comparative blend which have not been preselected to provide flowability in a thermoplastic resin, the flax bast fibers having particle sizes effective for increasing at least one of tensile strength and flexural strength of the resin which includes the flax bast fiber portion and flax shive portion by at least about 10% when the flax bast fiber portion is present in the resin in an amount of 30% by weight.

6. The fiber reinforced resin composite as recited in claim 5 wherein about 5 weight percent or less of the shives in the shive portion have a particle size of about 500 microns or more and about 35 weight percent or less of the flax bast fibers in the flax bast fiber portion have a particle size greater than 355 microns.

7. The fiber reinforced plastic composite as recited in claim 5 wherein the shive portion comprises 0–5 weight percent shives having a particle size greater than 500 $\mu$m with an average aspect ratio of 2.1, 2 to 12 weight percent shives having a particle size of from 355 to 500 $\mu$m with an average aspect ratio of 2.6, 2 to 25 weight percent shives having a particle size of from 250 to 355 $\mu$m with an average aspect ratio of 3.6, 2 to 30 weight percent shives having a particle size of from 150 to 250 $\mu$m with an average aspect ratio of 2.9, 0 to 25 weight percent shives having a particle size of from 75 to 150 $\mu$m with an average aspect ratio of 4.4; and the flax bast fiber comprises 0 to 35 weight percent bast fibers having a particle size greater than 500 $\mu$m with an average aspect ratio of 261, 0 to 35 weight percent bast fibers having a particle size of 355 to 500 $\mu$m with an average aspect ratio of 126, 0 to 40 weight percent bast fibers having a particle size of 250 to 355 $\mu$m with an average aspect ratio of 134, 1 to 25 weight percent bast fibers having a particle size of 150 to 250 $\mu$m with an average aspect ratio of 81, 0 to 20 weight percent bast fibers having a particle size of 75 to 150 $\mu$m with an average aspect ratio of 47, and 2 to 35 weight percent bast fibers having a particle size about 75 $\mu$m or less with an average aspect ratio of 6.1.

8. The fiber reinforced resin composite as recited in claim 5 wherein the flax bast fibers have an average aspect ratio of about 5.5 to about 300.0, and the shives have an average aspect ratio of about 1.5 to about 4.5.

9. The fiber reinforced resin composite as recited in claim 5 wherein the flax bast fiber portion of the blend comprises about 30% or more by weight of the composite.

10. The fiber reinforced resin composite as recited in claim 5 wherein the blend comprises about 40 to about 60 weight percent of the composite.

11. The fiber reinforced resin composite as recited in claim 5 wherein the blend is substantially uniformly distributed throughout the thermoplastic resin.

12. The fiber reinforced resin composite as recited in claim 5 wherein the thermoplastic resin comprises about 10 weight percent or more of the composite.

13. The fiber reinforced resin composite as recited in claim 5 wherein the thermoplastic resin comprises about 30% to about 65% by weight of the composite.

14. The fiber reinforced resin composite as recited in claim 5 wherein the thermoplastic resin has a melting point below the thermal decomposition point of the flax bast fibers and the shives.

15. The fiber reinforced resin composite as recited in claim 5 wherein the thermoplastic resin is selected from the group consisting of polypropylene, polyethylene, polyvinyl chloride, styrene, acrylonitrile, acrylonitrile-styrene, acrylonitrile-butadiene-styrene, polyester and mixtures thereof.

16. The fiber reinforced resin composite as recited in claim 5 wherein the thermoplastic resin has a melting point of about 140° C. or more, a density of about 1.5 g/cm$^3$ or less, and a weight average molecular weight in the range of from about 50,000 to about 900,000.

17. The fiber reinforced resin composite as recited in claim 5 wherein the composite has a tensile strength of about 10 MPa or more, a tensile modulus of about 0.5 GPa or more a flexural strength of about 15 Mpa or more, and a flexural modulus of about 0.4 GPa or more.

18. The fiber reinforced resin composite as recited in claim 5 wherein the composite is in the form of a pellet.

19. A process for making a flowable fiber blend of flax bast fibers and flax shives, the blend effective for reinforcing a thermoplastic resin, comprising:

providing a flax bast fiber portion having an average aspect ratio of about 6.0 to 265.0 and a flax shive portion having an average aspect ratio of about 2.0 to about 4.5, the flax bast fiber portion having flax bast fibers and the flax shive portion having flax shives, the bast fibers and flax shives having selected particle size ranges and aspect ratio ranges which are effective for making the blend more flowable than a comparative blend comprising about 70 weight percent shives and about 30 weight percent bast fibers with particle sizes and aspect ratios in the comparative blend which have not been preselected to provide flowability in a thermoplastic resin, the flax bast fibers having particle sizes effective for increasing at least one of tensile strength and flexural strength of the resin which includes the flax bast fiber portion and flax shive portion by at least about 10% when the flax bast fiber portion is present in the resin in an amount of 30% by weight; and combining the flax bast fiber portion and the flax shive portion effective to form the flowable fiber blend comprising from about 30 to about 55 weight percent of the bast fiber portion and from about 45 to about 70 weight percent of the shive portion.

20. The process for making a flowable fiber blend as recited in claim 19 wherein about 5 weight percent or less of the shives in the shive portion have a particle size of about 500 microns or more and about 35 weight percent or less of the flax bast fibers in the flax bast fiber portion have a particle size greater than 355 microns.

21. The process for making a flowable fiber blend as recited in claim 19 wherein the shive portion comprises 0–5 weight percent shives having a particle size greater than 500 $\mu$m with an average aspect ratio of 2.1, 2 to 12 weight percent shives having a particle size of from 355 to 500 $\mu$m with an average aspect ratio of 2.6, 2 to 25 weight percent shives having a particle size of from 250 to 355 $\mu$m with an average aspect ratio of 3.6, 2 to 30 weight percent shives having a particle size of from 150 to 250 $\mu$m with an average aspect ratio of 2.9, 0 to 25 weight percent shives having a particle size of from 75 to 150 $\mu$m with an average aspect ratio of 4.4; and the flax bast fiber comprises 0 to 35 weight percent bast fibers having a particle size greater than 500 $\mu$m with an average aspect ratio of 261, 0 to 35 weight percent bast fibers having a particle size of 355 to 500 $\mu$m with an average aspect ratio of 126, 0 to 40 weight percent bast fibers having a particle size of 250 to 355 $\mu$m with an average aspect ratio of 134, 1 to 25 weight percent bast fibers having a particle size of 150 to 250 $\mu$m with an average aspect ratio of 81, 0 to 20 weight percent bast fibers having a particle size of 75 to 150 $\mu$m with an average aspect ratio of 47, and 2 to 35 weight percent bast fibers having a particle size about 75 $\mu$m or less with an average aspect ratio of 6.1.

22. A process for making a fiber reinforced resin composite, comprising:

providing a fiber blend comprising about 30 to about 55 weight percent of a flax bast fiber portion having an average ratio of about 6.0 to about 265 and having flax bast fibers and about 45 to about 70 weight percent of a flax shive portion having an average aspect ratio of about 2.0 to about 4.5 and having flax shives, the bast fibers and flax shives having selected particle size ranges and aspect ratio ranges which are effective for making the blend more flowable than a comparative blend comprising about 70 weight percent shives and about 30 weight percent bast fibers with particle sizes and aspect ratios in the comparative blend which have not been preselected to provide flowability in a thermoplastic resin, the flax bast fibers having particle sizes effective for increasing at least one of tensile strength and flexural strength of the resin which includes the flax bast fiber portion and flax shive portion by at least about 10% when the flax bast fiber portion is present in the resin in an amount of 30% by weight; and mixing a thermoplastic resin in flowable condition with the fiber blend effective to form a flowable, thermoformable composite composition.

23. The process for making a fiber reinforced resin composite as recited in claim 22 further comprising feeding the flowable composite composition through a constriction located at a feeding entrance, wherein the fiber blend reduces clumping of the flax bast fibers in the blend as compared to using a comparative blend of 30 weight percent flax bast fibers and 70 weight percent flax shives with particle sizes and aspect ratios which have not been preselected to provide flowability in a thermoplastic resin.

24. The process for making a fiber reinforced resin composite as recited in claim 22 further comprising:

forming the composite composition into a predetermined shape; and hardening or permitting hardening of the shaped composite composition.

25. The process for making a fiber reinforced resin composite as recited in claim 22 wherein said forming being selected from the group consisting of injection molding, compression molding, blow molding, extruding, rotational molding, pelletizing, and casting.

26. The process for making a fiber reinforced resin composite as recited in claim 22 wherein the mixing comprises dispersing the fiber blend substantially uniformly throughout the thermoplastic resin.

27. The process for making a fiber reinforced resin composite as recited in claim 22 wherein the mixing further comprising adding a processing aid selected from the group consisting of a maleated polypropylene, a maleated polyethylene, a functionalized polyolefin and mixtures thereof.

28. The process for making a fiber reinforced resin composite as recited in claim 22 wherein about 5 weight percent or less of the shives in the shive portion have a particle size of about 500 microns or more and about 35 weight percent or less of the flax bast fibers in the flax bast fiber portion have a particle size greater than 355 microns.

29. The process for making a fiber reinforced plastic composite as recited in claim 22 wherein the shive portion comprises 0–5 weight percent shives having a particle size greater than 500 μm with an average aspect ratio of 2.1, 2 to 12 weight percent shives having a particle size of from 355 to 500 μm with an average aspect ratio of 2.6, 2 to 25 weight percent shives having a particle size of from 250 to 355 μm with an average aspect ratio of 3.6, 2 to 30 weight percent shives having a particle size of from 150 to 250 μm with an average aspect ratio of 2.9, 0 to 25 weight percent shives having a particle size of from 75 to 150 μm with an average aspect ratio of 4.4; and the flax bast fiber comprises 0 to 35 weight percent bast fibers having a particle size greater than 500 μm with an average aspect ratio of 261, 0 to 35 weight percent base bast fibers having a particle size of 355 to 500 μm with an average aspect ratio of 126, 0 to 40 weight percent bast fibers having a particle size of 250 to 355 μm with an average aspect ratio of 134, 1 to 25 weight percent bast fibers having a particle size of 150 to 250 μm with an average aspect ratio of 81, 0 to 20 weight percent bast fibers having a particle size of 75 to 150 μm with an average aspect ratio of 47, and 2 to 35 weight percent bast fibers having a particle size about 75 μm or less with an average aspect ratio of 6.1.

30. The blend of flax bast fibers and flax shives as recited in claims 1, wherein the shive portion comprises from about 45 to about 70 weight percent of the blend and the bast fiber portion comprises from about 30 to about 55 weight percent of the blend.

31. The blend as recited in claim 1, wherein the blend further comprises additional milled fibers selected from the group consisting of inorganic fibers, organic fibers and mixtures thereof.

32. The blend as recited in claim 31, wherein the inorganic fibers are selected from the group consisting of glass, wollastonite, quartz, basalt, carbon, metal and mixtures thereof and the organic fibers are selected from the group consisting of polyamide, polyester, cellulose, modified cellulose fibers, polyolefin fibers and mixtures thereof.

33. The blend as recited in claim 31, wherein the additional fiber is about 2 weight percent or more of the fiber fraction.

34. The blend as recited in claim 33, wherein the additional fiber comprises from about 5 weight percent to about 90 weight percent of the fiber fraction.

35. The blend as recited in claim 33, wherein the additional fiber comprises from about 15 weight percent to about 60 weight percent of the fiber fraction.

36. The fiber reinforced resin composite as recited in claim 5, wherein the shive portion comprises from about 45 to about 70 weight percent of the blend and the bast fiber portion comprises from about 30 to about 55 weight percent of the blend.

37. A blend of flax bast fibers and flax shives adapted for use as a reinforcing agent for a thermoplastic resin, the blend comprising:

a flax bast fiber portion; and a flax shive portion, the flax bast fiber portion having flax bast fibers and the flax shive portion having flax shives, the shive portion comprises 0–5 weight percent shives having a particle size greater than 500 μm with an average aspect ratio of 2.1, 2 to 12 weight percent shives having a particle size of from 355 to 500 μm with an average aspect ratio of 2.6, 2 to 25 weight percent shives having a particle size of from 250 to 355 μm with an average aspect ratio of 3.6, 2 to 30 weight percent shives having a particle size of from 150 to 250 μm with an average aspect ratio of 2.9, 0 to 25 weight percent shives having a particle size of from 75 to 150 μm with an average aspect ratio of 4.4; and the flax bast fiber comprises 0 to 35 weight percent bast fibers having a particle size greater than 500 μm with an average aspect ratio of 261, 0 to 35 weight percent bast fibers having a particle size of 355 to 500 μm with an average aspect ratio of 126, 0 to 40 weight percent bast fibers having a particle size of 250 to 355 μm with an average aspect ratio of 134, 1 to 25 weight percent bast fibers having a particle size of 150 to 250 μm with an average aspect ratio of81, 0 to 20 weight percent bast fibers having a particle size of 75 to 150 μm with an average aspect ratio of 47, and 2 to 35 weight percent bast fibers having a particle size about 75 μm or less with an average aspect ratio of 6.1.

38. A blend of flax bast fibers and flax shives adapted for use as a reinforcing agent for a thermoplastic resin, the blend comprising:

a flax bast fiber portion; and a flax shive portion, wherein the flax bast portion comprises about 15 to about 70 weight percent of the blend, the flax bast portion having flax bast fibers which have an average aspect ratio of about 6.0 to about 265.0, and wherein the flax shive portion comprises about 30 to about 85 weight percent of the blend, the flax shive portion having flax shives which have an average aspect ratio of about 2.0 to about 4.5.

39. A blend of flax bast fibers and flax shives as recited in claim 38 wherein the shive portion comprises from about 45 to about 70 weight percent of the blend and the bast fiber portion comprises from about 30 to about 55 weight percent of the blend.

40. A fiber reinforced resin composite, comprising:

a thermoplastic resin; and a fiber blend, the fiber blend included in the thermoplastic resin, wherein the fiber blend comprises a flax bast fiber portion and a flax shive portion, the flax bast portion having flax bast fibers and the flax shive portion having flax shives;

wherein the shive portion comprises from about 45 to about 70 weight percent of the blend, with an average aspect ratio of about 1.5 to about 4.5, wherein the shive portion comprises 0 to 5 weight percent shives having a particle size greater than 500 μm with an average aspect ratio of 2.1, 2 to 12 weight percent shives having a particle size of from 355 to 500 μm with an average aspect ratio of 2.6, 2 to 25 weight percent shives having a particle size of from 250 to 355 μm with an average aspect ratio of 3.6, 2 to 30 weight percent shives having a particle size of from 150 to 250 μm with an average aspect ratio of 2.9, 0 to 25 weight percent shives having a particle size of from 75 to 150 μm with an average aspect ratio of 4.4; and wherein the flax bast fiber portion comprises from about 30 to about 55 weight percent of the blend, with an average aspect ratio of about 5.5 to about 300.0, the flax bast fiber comprises 0 to 35 weight percent bast fibers having a particle size greater than 500 μm with an average aspect ratio of 261, 0 to 35 weight percent bast fibers having a particle size of 355 to 500 μm with an average aspect ratio of 126, 0 to 40 weight percent bast fibers having a particle size of 250 to 355 μm with an average aspect ratio of 134, 1 to 25 weight percent bast fibers having a particle size of 150 to 250 μm with an average aspect ratio of 81, 0 to 20 weight percent bast fibers having a particle size of 75 to 150 μm with an average aspect ratio of 47, and 2 to 35 weight percent bast fibers having a particle size about 75 μm or less with an average aspect ratio of 6.1.

41. A fiber reinforced resin composite, comprising:

from about 10 to about 90 weight percent of a thermoplastic resin; and a fiber blend, the fiber blend included in the thermoplastic resin, wherein the fiber blend comprises a flax bast fiber portion and a flax shive portion, the flax bast portion having flax bast fibers and the flax shive portion having flax shives, wherein the flax bast portion comprises about 30 to about 55 weight percent of the blend, the flax bast portion having flax bast fibers which have an average aspect ratio of about 6.0 to about 265.0, and wherein the flax shive portion comprises about 45 to about 70 weight percent of the blend, the flax shive portion having flax shives which have an average aspect ratio of about 2.0 to about 4.5, the composite having about 30 weight percent or more bast fiber portion.

42. The fiber reinforced composite as recited in claim 41 wherein the resin comprises from about 30 to about 65 weight percent of the composite.

43. A process for making a flowable fiber blend of flax bast fibers and flax shives, the blend effective for reinforcing a thermoplastic resin, comprising:

providing a flax bast fiber portion and a flax shive portion, the flax bast fiber portion having flax bast fibers and the flax shive portion having flax shives; and combining the flax bast fiber portion and the flax shive portion effective to form the flowable fiber blend comprising from about 30 to about 55 weight percent of the bast fiber portion, wherein the flax bast fibers have an average aspect ratio of about 6.0 to about 265.0, and from about 45 to about 70 weight percent of the flax shive portion, wherein the flax shives have an average aspect ratio of about 2.0 to about 4.5:

wherein the shive portion comprises 0–5 weight percent shives having a particle size greater than 500 μm with an average aspect ratio of 2.1, 0.2 to 12 weight percent shives having a particle size of from 355 to 500 μm with an average aspect ratio of 2.6, 2 to 25 weight percent shives having a particle size of from 250 to 355 μm with an average aspect ratio of 3.6, 2 to 30 weight percent shives having a particle size of from 150 to 250 μm with an average aspect ratio of 2.9, 0 to 25 weight percent shives having a particle size of from 75 to 150 μm with an average aspect ratio of 4.4; and the flax bast fiber comprises 0 to 35 weight percent bast fibers having a particle size greater than 500 μm with an average aspect ratio of 261, 0 to 35 weight percent base fibers having a particle size of 355 to 500 μm with an average aspect ratio of 126, 0 to 40 weight percent bast fibers having a particle size of 250 to 355 μm with an average aspect ratio of 134, 1 to 25 weight percent bast fibers having a particle size of 150 to 250 μm with an average aspect ratio of 81, 0 to 20 weight percent bast fibers having a particle size of 75 to 150 μm with an average aspect ratio of 47, and 2 to 35 weight percent bast fibers having a particle size about 75 μm or less with an average aspect ratio of 6.1.

44. The process as recited in claim 43 wherein the flax bast fibers have an average aspect ratio of about 5.5 to about 300.0, and the shives have an average aspect ratio of about 1.5 to about 4.5.

45. A process for making a flowable fiber blend of flax bast fibers and flax shives, the blend effective for reinforcing a thermoplastic resin, comprising:

providing a flax bast fiber portion and a flax shive portion, the flax bast fiber portion having flax bast fibers and the flax shive portion having flax shives, wherein the flax bast fibers have an average aspect ratio of about 6.0 to about 265.0, and the flax shives have an average aspect ratio of about 2.0 to about 4.5; and combining the flax bast fiber portion and the flax shive portion effective to form the flowable fiber blend comprising from about 30 to about 55 weight percent of the bast fiber portion and from about 45 to about 70 weight percent of the shive portion.

46. The process as recited in claim 45, wherein the shive portion comprises from about 45 to about 70 weight percent of the blend and the bast fiber portion comprises from about 30 to about 55 weight percent of the blend.

* * * * *